US009010064B1

(12) United States Patent
Farahmandpour

(10) Patent No.: US 9,010,064 B1
(45) Date of Patent: Apr. 21, 2015

(54) MASONRY TIE

(71) Applicant: Kamran Farahmandpour, Long Grove, IL (US)

(72) Inventor: Kamran Farahmandpour, Long Grove, IL (US)

( * ) Notice: Subject to any disclaimer, the term of this patent is extended or adjusted under 35 U.S.C. 154(b) by 0 days.

(21) Appl. No.: 14/192,638

(22) Filed: Feb. 27, 2014

(51) Int. Cl.

| | |
|---|---|
| ***E04B 1/38*** | (2006.01) |
| ***E04C 5/00*** | (2006.01) |
| ***E04B 1/76*** | (2006.01) |
| ***E04B 1/41*** | (2006.01) |

(52) U.S. Cl.
CPC ..... *E04B 1/7616* (2013.01); *E04B 1/40* (2013.01)

(58) Field of Classification Search
CPC ... E04B 1/7616; E04B 1/2608; E04B 1/4178; E04B 2/8635; E04B 2/30; E04B 1/41; E04B 1/4185; E04B 1/40; E04D 5/145; E04D 5/146
USPC ..... 52/562, 565, 568, 379, 712–714, 426, 52/428, 410, 126.1, 126.3
See application file for complete search history.

(56) References Cited

U.S. PATENT DOCUMENTS

| | | | | |
|---|---|---|---|---|
| 5,299,403 | A * | 4/1994 | Fentz | 52/404.2 |
| 5,660,015 | A * | 8/1997 | Kluser | 52/410 |
| 5,675,942 | A * | 10/1997 | Crawford | 52/127.3 |
| 6,131,360 | A * | 10/2000 | Dalen | 52/712 |
| 2006/0185319 | A1 * | 8/2006 | Kufner et al. | 52/749.11 |
| 2010/0263304 | A1 * | 10/2010 | Torrents I Comas | 52/126.5 |
| 2012/0085066 | A1 * | 4/2012 | Kufner et al. | 52/749.11 |

* cited by examiner

*Primary Examiner* — Brian Glessner
*Assistant Examiner* — Brian D Mattei
(74) *Attorney, Agent, or Firm* — Erickson Law Group, PC

(57) ABSTRACT

Masonry tie is provided having a base and a retainer plate. The base has back plate and a shaft extending from the back plate. The shaft has a plurality of teeth. The retainer plate has a receiving opening configured to receive the shaft. The retainer plate has a locking arm adjacent the receiving opening. The locking arm is biased to engage at least one of the plurality of teeth when the at least one of the plurality of teeth is adjacent the locking arm to releasably prevent the retainer plate from moving in at least one direction.

19 Claims, 14 Drawing Sheets

MASONRY TIE

FIELD OF THE INVENTION

This invention relates in general to devices for constructing walls.

BACKGROUND OF THE INVENTION

The use of continuous insulation is mandated for some climates in the United States by newer energy codes, such as 2012 International Energy Conservation Code (IECC) and 2012 International Green Construction Code. The purpose of continuous insulation is to eliminate thermal breaks that reduce thermal efficiency of insulation placed between framing members such as wall studs.

One efficient and technically sound exterior wall assembly that can function in all climates without any theoretical potential for condensation is a wall assembly in which rigid insulation boards or foam are placed outside of an air barrier (AB)/weather-resistive barrier (WRB) (i.e., within the wall drainage cavity). Such a wall assembly is often referred to as a "work everywhere wall." The use of continuous insulation in such a wall assembly requires the use of frequently placed conventional metal ties to connect the wall cladding (i.e., masonry or other types of cladding) to the back-up wall. The function of these ties is to transfer lateral loads such as wind loads from the cladding (masonry veneer) to the back-up wall which acts as the structural support for the cladding.

In most masonry assemblies, metal masonry ties need to be installed at 16 inches on center in horizontal and vertical directions to meet building code requirements. These metal ties pass through the continuous insulation and result in thermal breaks that reduce the efficiency of the continuous insulation.

Many commercially available metal ties are made using galvanized steel. When such ties are integrated into the wall assembly, they cannot be replaced without removal of the masonry veneer. The life expectancy of masonry veneer is anticipated to be more than 70 years. During the life cycle of steel masonry ties, they are exposed to the environment within the wall cavity which is constantly moist. This environment and damage to the galvanizing layer caused during installation can cause corrosion of the metal ties. In some cases, structural collapse of the masonry veneer due to corrosion of metal ties has been documented.

The present inventor recognized the need for an improved masonry tie that reduces thermal bridging where the ties penetrate the continuous insulation. The present inventor recognized the need for an improved masonry tie that is less susceptible to deterioration by moisture and weather conditions.

When installing continuous insulation panels, the panels are often installed in complete contact with the AB/WRB on the back-up surface. This prevents proper drainage of water on the exterior face of the AB/WRB. Water can be trapped in the minute gap between the continuous insulation and AB/WRB due to capillary action. This trapped water can cause accelerated deterioration of ties and other components.

The present inventor recognized the need for an improved masonry tie that creates a gap between the continuous insulation panels and AB/WRB. This gap facilitates drainage.

Conventional masonry ties do not provide any mechanism for ensuring that the continuous insulation panels are held in place. As such, continuous insulation panels are often installed with adhesive backing to ensure they stay in place. This adhesive backing can impede drainage of water on the drainage plane and can degrade and fail over time under certain circumstances. This adhesive backing will also results in additional labor and material costs.

The present inventor recognized the need for a masonry tie that can retain the continuous insulation panels in place and eliminate the need of reliance of adhesive backing.

Certain building codes restrict the length of conventional metal ties to 4 inches because longer length conventional ties are susceptible to buckling under compressive load. The present inventor recognized the need to transfer some compressive force from the masonry tie onto the insulation to reduce or eliminate the possibility of buckling under compressive loads and to reduce the effective span of the tie shaft within the cavity.

SUMMARY OF THE INVENTION

A masonry tie for connecting a veneer wall to a backup wall is disclosed. In some embodiments the masonry tie has a base and a retainer plate. The base has a back plate and a shaft extending from the back plate. The shaft has a plurality of teeth. The retainer plate has a receiving opening configured to align with and slide along the shaft. The retainer plate has a locking arm adjacent the receiving opening. The locking arm is biased to engage at least one of the plurality of teeth when the at least one of the plurality of teeth is adjacent the locking arm to prevent the retainer plate from moving in at least one direction.

In some embodiments, the back side of the back plate is concave to provide for a more uniform pressure on the back-up surface when fastened to the back-up. The back side of the retainer plate is also concave to provide for uniform compressive pressure against the rigid insulation boards.

In some embodiments, the locking arm comprises a release position and an engaged position. The locking arm is engaged with the at least one of the plurality of teeth of the shaft when the at least one of the plurality of teeth is adjacent the locking arm to prevent the retainer plate from moving in at least one direction when in the engaged position. The locking arm is released from the plurality of teeth and the retainer plate is free to move in two directions along the shaft when the locking arm is in the raised released position.

In some embodiments, the locking arm has locking arm teeth that engage with the plurality of teeth of the shaft to prevent the retainer plate from moving in the at least one direction.

In some embodiments, the back plate comprises one or more fastening apertures for securing the back plate to a backup wall.

In some embodiments, the shaft comprises a mounting passage extending transversely through the shaft.

In some embodiments, the shaft comprises a cylindrical mounting passage extending transversely through the shaft, the mounting passage located long the shaft between the back plate and the plurality of teeth.

In some embodiments, the shaft comprises a corrugated section at an end portion of the shaft opposite the back plate to facilitate mechanical interlock with mortar of a masonry joint.

In some embodiments, the shaft comprises a masonry anchor aperture at an end portion of the shaft opposite the back plate and an elongated portion of a masonry anchor is engageable with the masonry anchor aperture of the shaft.

A method of connecting a veneer wall to a backup wall is also disclosed. A base is secured to the backup wall. The base comprises an elongated member extending from a back plate. The elongated member comprises a plurality of teeth. Insulation is placed over at least a portion of the back plate. A ratcheting arm of a retaining plate is engaged with at least a portion of the plurality of teeth by sliding the retaining plate onto the elongated member and locking the retaining plate against the insulation. The veneer wall is subsequently constructed and the elongated member is embedded in a mortar joint of the veneer wall.

Numerous other advantages and features of the present invention will become readily apparent from the following detailed description of the invention and the embodiments thereof, from the claims, and from the accompanying drawings.

DETAILED DESCRIPTION

Figure 1:
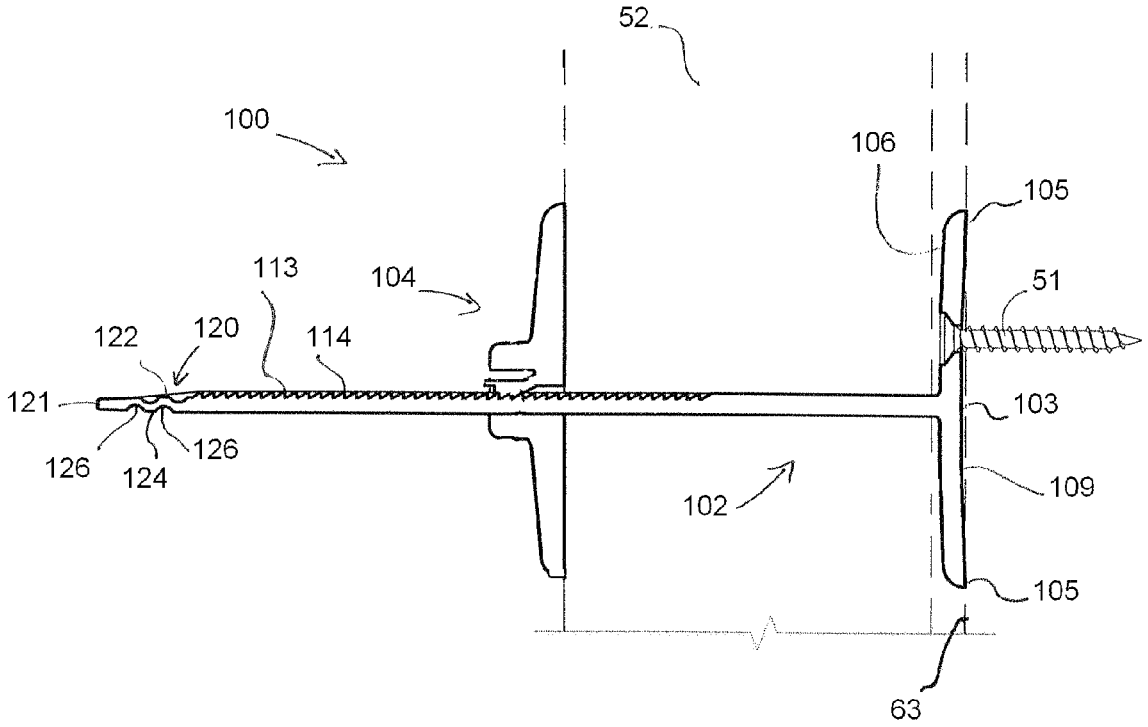
FIG. 1 is a side sectional view of a first embodiment of a masonry tie of the invention.

A masonry tie is disclosed. The following description is presented to enable any person skilled in the art to make and use the invention. For the purposes of explanation, specific nomenclature is set forth to provide a plural understanding of the present invention. While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
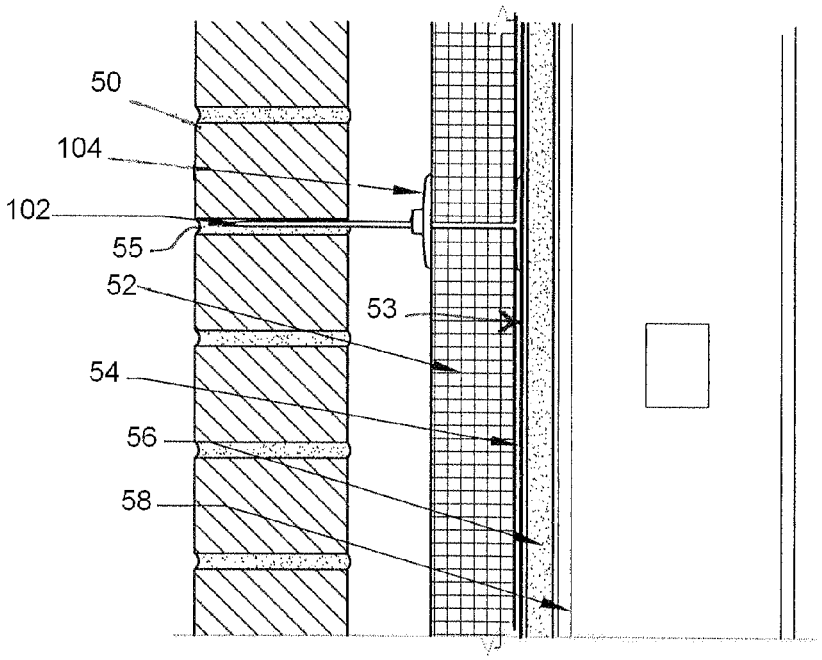
FIG. 2 is a side view of the masonry tie of FIG. 1 shown in an application.
Figure 3:
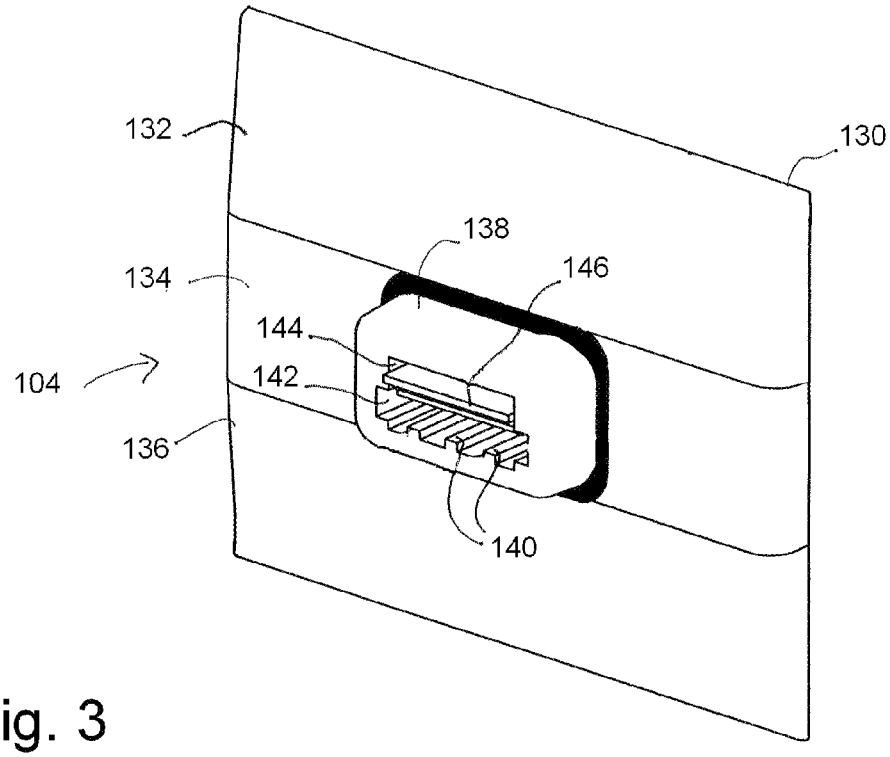
FIG. 3 is a perspective view of a retainer plate of the masonry tie of FIG. 1.

FIGS. 1-7 show a first embodiment masonry tie 100. The masonry tie 100 comprises a base 102 and a retainer plate 104. In some embodiments, both components are manufactured using a semi-rigid plastic material. FIG. 2 shows the masonry tie deployed in one type of application. The base is attached to a backup wall 53. In some embodiments, the backup wall 53 may have an air barrier (AB) and/or weather-resistant barrier (WRB) 54, placed over an exterior wall board 56, placed over wall studs 58. In some applications, the base may be attached over the air barrier and/or weather-resistant barrier 54. The base may be used on other walls or backup wall arrangements known in the art.

The base 102 has a back plate 106 and a shaft 112 extending from the back plate. In some embodiments, the shaft extends perpendicular from the back plate. The shaft 112 has a blank portion 118, a toothed section 114, and an end portion 120. The blank portion 118 is adjacent the back plate 106.

Adjacent the blank portion 118 opposite the back plate is the toothed section 114. The length of the blank portion 118 may depend on the desire thickness of the insulation panels 52 of a given application. The toothed section 114 has a plurality of shaft teeth 113 adjacent recesses 113*c*. On opposite lateral sides of the toothed section are shoulders 116. The shoulders 116 provide improved rigidity in the vertical direction in resistance against buckling under compressive load. In addition the shoulders 116 assist in alignment when the shaft is inserted in a receiving opening 142 of the retaining plate.

Figure 5:
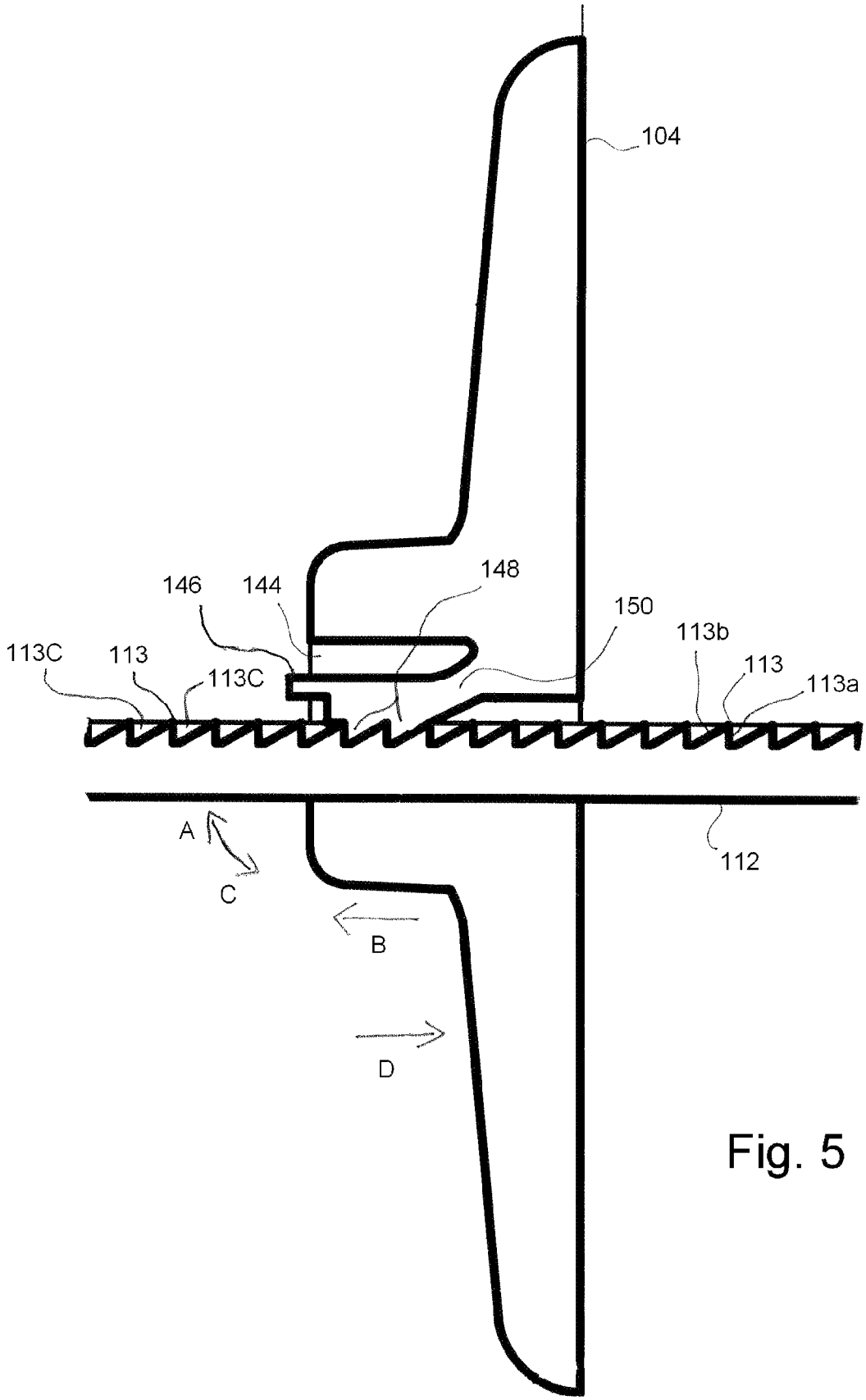
FIG. 5 is an enlarged side sectional view of the retainer plate and a shaft taken from FIG. 1.

The teeth 113 comprise a vertical raised portion 113*a* intersecting an angled second portion 113*b* to form a peek as can best be seen from FIG. 5. In some embodiments the toothed portion comprises anywhere between 40% and 80% or more of the length of the shaft.

Adjacent the toothed portion 114 opposite the blank portion 118 on the shaft is the end portion 120. The end portion 120 may be tapered along its length from the toothed section to the end 121. The tapered arrangement allows for easier installation into the receiving opening 142 of the retaining plate.

The end portion comprises a corrugated section. The corrugated section comprises at least one plateau 122 flanked by recesses on the top and at least one plateau 124 flanked by recesses 126 on the bottom. The plateau 122 on the top is offset from the plateau 124 on the bottom. The plateaus and recesses provide a gripping surface for securing the same within the mortar joint of masonry as shown in FIG. 2. While of the plateaus 122 are shown as plateaus, other raised arrangements such as curved mounds or toothed/serrated portions can be provided in the end portion 120.

Figure 4:
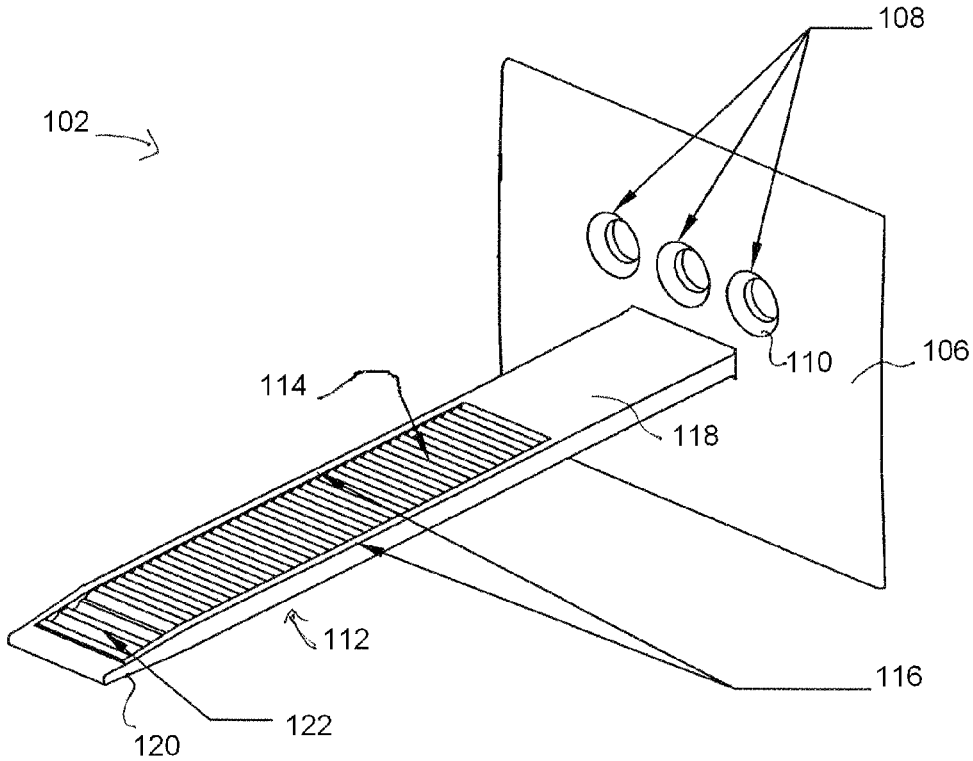
FIG. 4 is a perspective view of a base of the masonry tie of FIG. 1.

The back plate 106 comprises one or more fastening apertures 108. Multiple fastening apertures allow for increased variably in alignment with studs in the back-up wall. The fastening apertures may comprise countersunk recesses 110 is shown in FIG. 4. In one embodiment, the apertures are located above the shaft and are centered laterally over the shaft. Screws 51 or other fasteners may be inserted into and through the fastening apertures to secure the base to an exterior surface, such as the backup wall 53. The base may comprise an amount of pre-applied mastic or sealant at the fastening apertures to help seal the air barrier and/or weather-resistant barrier 54 at the point of fastener penetration.

Fastener apertures may be located in other locations other than those shown in FIG. 4 and may be provided in more or less than three apertures as shown.

In some embodiments, the back plate has a concave back surface 109. The concave arrangement provides that the entire perimeter 105, from the top, bottom, left, and right edges, of the back surface 109 is located closer to the straight plane 63, such as might be provided by the backup wall 61, as compared to the center 103. Therefore, the back plate is continuously curved from the perimeter to the center 103. Therefore the back surface 109 is slightly concave. The concave or cupped arrangement provides for a more uniform pressure on the back-up wall surface when fastened to the back-up wall 61. This occurs because the pressure of the screws drawing the back plate against the backup wall surface causes the concave back surface 109 to flex and flatten against the backup wall surface. This can result in a more uniform pressure applied across the external surface, such as the backup wall surface, from the back plate. Although not shown, the back surface of the retainer plate 104, the surface intended to be installed against the rigid insulation panels, is concave in the same manner as just described regarding surface 109 of the back plate to provide for uniform compressive pressure against the rigid insulation panels 52. Therefore, when the retainer plate is locked against the insulation panel (s), the central location of the receiving opening 142 and locking arm 164 lock the back plate against the backup wall surface causing the concave back surface of the retainer plate to flex and flatten against the insulation panel if sufficient force is applied to the retaining plate. This arrangement better distributes the load across the insulation panel in the area where the retainer plate contacts the insulation panel and reduces the chance that the insulation panel will be indented or crushed by the pressure applied to the retainer plate.

The retainer plate 104 comprises a plate body 130. The plate body 130 comprises an upper section 132, a middle section 134, and a lower section 136. The upper and lower sections may be tapered towards the middle section which may be raised relative to the upper and lower sections. The middle section 134 comprises an engagement portion 138. The engagement portion 138 is raised from the middle section and forms a rectangular shape with curved exterior edges. The engagement portion 138 comprises a receiving opening 142 that extends through the engagement portion and the plate body. The receiving opening is configured, as shown in FIG. 1, to receive the shaft there through. Adjacent the receiving opening 142 is a locking arm 146 with locking arm teeth 148 which together with the shaft teeth create a ratcheting mechanism to secure the retainer plate against movement in the direction B of FIG. 5. The locking arm can be provided with one, two, or more than two locking arm teeth 148.

The locking arm 146 is biased to extend into the receiving opening 142 in the direction C of FIG. 5. When the shaft 112 is inserted into the receiving opening 142 at least the teeth 148 engage with the shaft and the shaft drives the locking arm 146 about pivot location 150 in the direction A. The locking arm comprises downward extending locking arm teeth 148. The locking arm teeth 148 engage with the shaft teeth 113. The engagement between the teeth 148 and teeth 113 prevent the retainer plate 104 from moving away from the base in the direction B shown in FIG. 5.

The locking arm teeth 148 can be disengaged from the shaft teeth 113 by pulling the locking arm 148 upward in the direction A of FIG. 5 into an upper area 144. When the locking arm teeth 148 are disengaged from the shaft teeth 113, the retaining plate can be removed in the direction B.

The locking arm 146 does not need to be raised, to disengage the locking arm teeth 148 from the shaft teeth 113, in order to allow the retainer plate 104 to move in direction D relative to the shaft. When the retainer plate 104 is moved in direction D relative to the shaft 112, angled portions of the teeth 148 will slide along the angled second portions 113*b* of the shaft teeth 113 from one tooth to the next until the retaining plate is no longer moved in direction B or the retaining plate meets an exterior surface, such as continuous insulation panels 52. In this way, the retaining plate can secure the continuous insulation panels 52 against the backup wall 53 at least until the locking arm is moved in the direction A to release the locking arm teeth 148 from the shaft teeth 113. Therefore the locking arm 146 has a raised position in the direction A where the locking arm teeth 148 are disengaged from the shaft teeth 113 so that the retaining plate can move in direction B. The locking arm 146 has a lowered or engaged position where the locking arm teeth 148 are engaged with the shaft teeth 113 so that the retaining plate is prevented from moving in the direction B.

The retainer plate is capable of securing the insulation in place. In addition, the retaining plate also transfers a portion of the compressive force from the masonry veneer 50, under positive wind or other loads, to the insulation panels 52 via the shaft 112 connection with the masonry veneer 50 and the retainer plate 104. Such load may also be transferred from the insulation panels to the back-up wall 53. This load transfer from the masonry veneer 50 to the insulation and/or the backup will assist in the prevention of buckling of the shaft where the insulation thickness and/or cavity are large, such as where the cavity is more than 4 inches.

Figure 6:
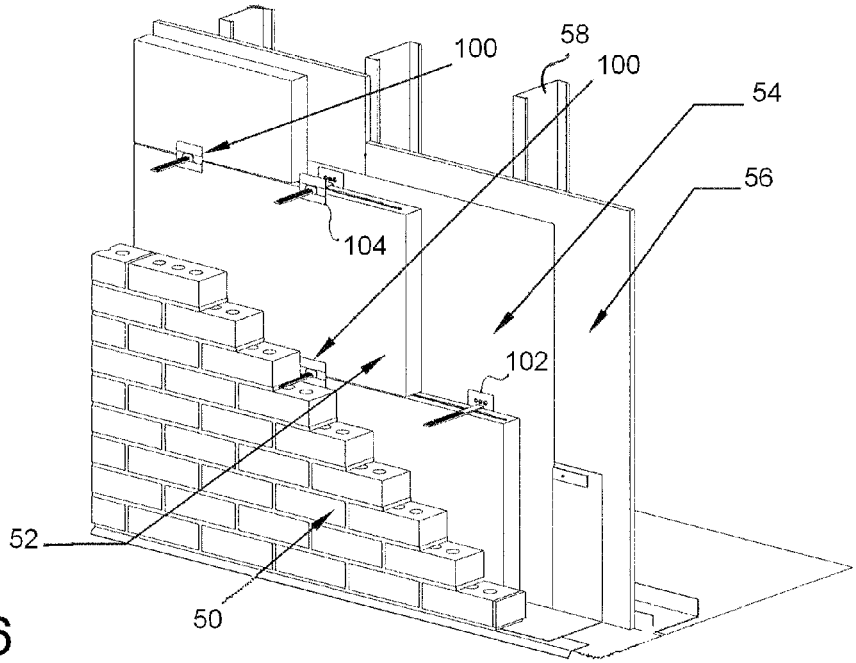
FIG. 6 is a perspective view of a plurality of masonry ties of FIG. 1 shown in an application.
Figure 7:
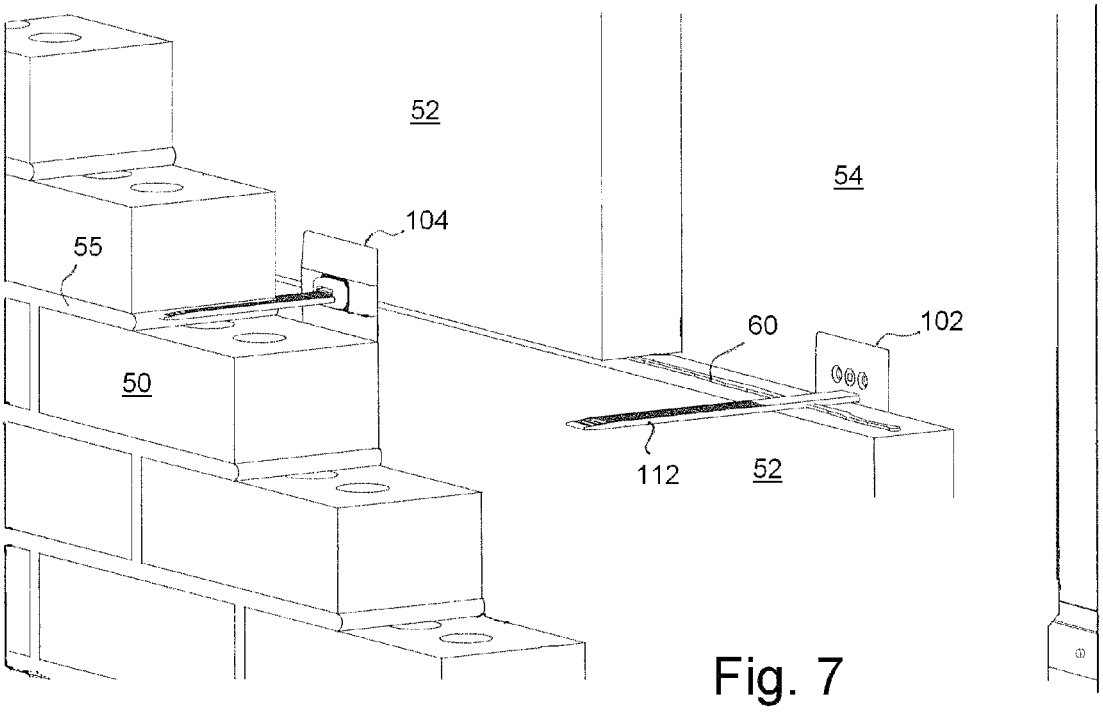
FIG. 7 is an enlarged perspective view of a plurality of masonry ties in the application taken from FIG. 6.
Figure 8:
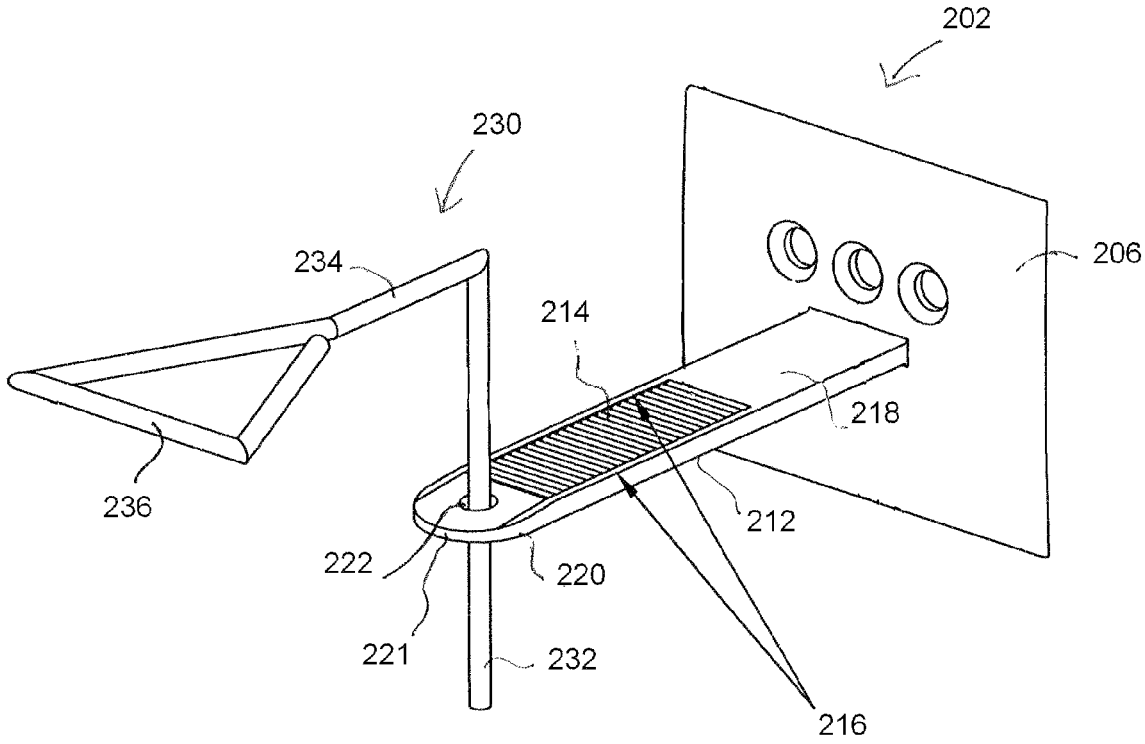
FIG. 8 is a perspective view of a based plate of a second embodiment masonry tie with a masonry anchor.

FIGS. 6 and 7 show one application where the masonry tie 100 can be used. After the base(s) 102 is installed on the backup wall, insulation panels 52 can be installed between the shafts 112 of spaced apart bases, or each row of ties can be installed after setting the underlying row of insulation panels 52. The base can be installed after the AB/WRB is installed on the backup wall. Under other methods, the bases 102 can be installed concurrently with the insulation panels 52. The insulation panels 52 are then held in place by pushing the retainer plate 104 on the corresponding shaft 112 of the base until the back of the retainer plate 104 is in contact with the insulation panel 52. The locking arm 146 engages the shaft in a ratcheting action. The back side of the insulation panels 52 rest against the back plate 106 of the base 102, providing for proper alignment and a small gap between the insulation panel 52 and the back-up wall for drainage. In some application, a bead of sealant 60, such as polyurethane or silicone sealant can be applied to the top and/or bottom wall of the insulation panels 52 as shown in FIG. 7 to seal between adjacent panels and around the shaft 112 of the base.

The base 102 can be positioned on the backup wall so that the corresponding shaft 112 will be located at a mortar joint 55 or seam. Then the masonry veneer 50 can be constructed so that at least a portion of the end portion 120 is located in a mortar joint 55 between adjacent bricks or blocks as shown in FIGS. 2 and 6-7. In some applications, the entire length of the end portion 120 is surrounded by mortar in a mortar joint. In some applications, a portion of the toothed section 114 together with the end portion 120 is located in the mortar joint 55. The plateaus and recesses of the end portion 120 provide a gripping surface for securing the same within mortar joint 55. When the toothed section is located in the mortar join, the teeth 113 also provide a gripping surface for securing the same within mortar joint 55.

In some embodiments, the masonry tie is formed of plastic. Plastic will not corrode and is less susceptible to moisture and weather related damage. In some embodiments, at least the shaft is formed of plastic which has some elasticity allowing differential movements between the backup wall and the masonry veneer. Further plastic is a better insulator as compared with steel and will lessen or eliminate any thermal transfer at the tie.

In some embodiments, the shaft has a thickness 3 mm or less, which results in lower rigidity compared to conventional metal ties. The reduced thickness reduces the gap between adjacent insulation panels and therefore requires less sealant to fill the gap.

Second Embodiment

FIGS. 8-12 show a second embodiment masonry tie 200. The second embodiment comprises a modified base 202 and the retainer plate 104 from the first embodiment masonry tie 100.

The second embodiment base 202 is identical to base 102, except for the end portion 220 of base 202. The base 202 has a back plate 206 and a shaft 212 extending from the back plate. The shaft 212 has a blank portion 218, a toothed section 214 comprising teeth 213, and an end portion 220. The blank portion 218 is adjacent the back plate 206. The toothed section 214 has a plurality of teeth 213. On opposite lateral sides of the toothed section are shoulders 216.

Figure 9:
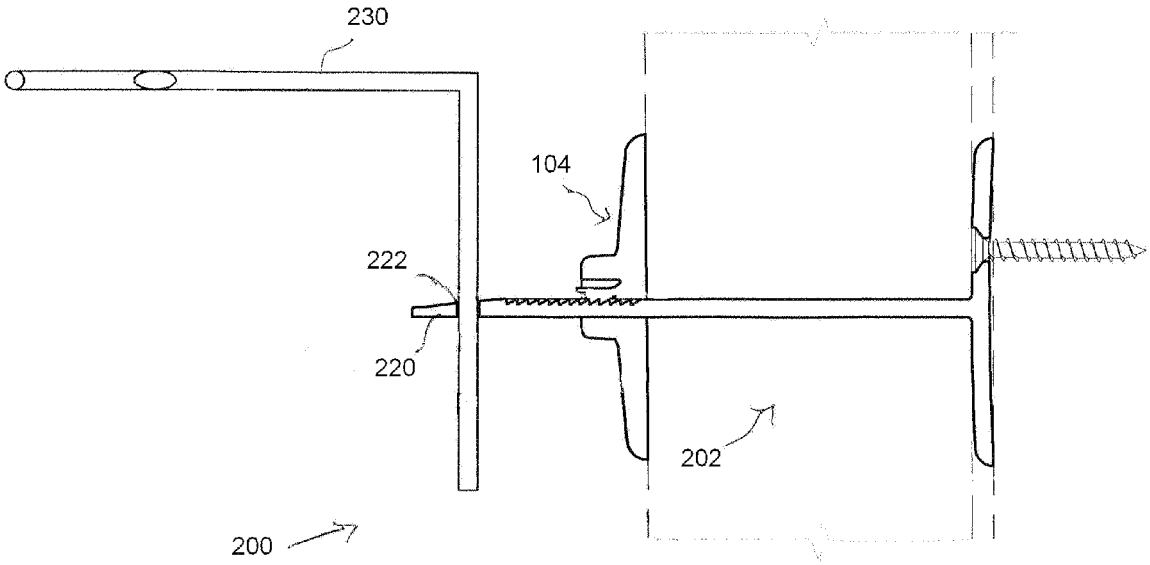
FIG. 9 is a side section view of the second embodiment masonry tie with a masonry anchor.
Figure 10:
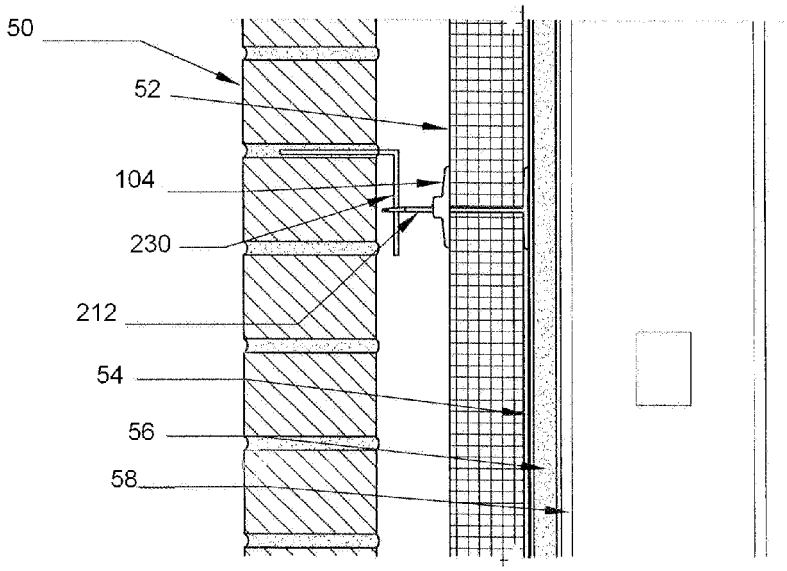
FIG. 10 is a side view of the masonry tie of FIG. 9 shown in an application with the masonry anchor.
Figure 11:
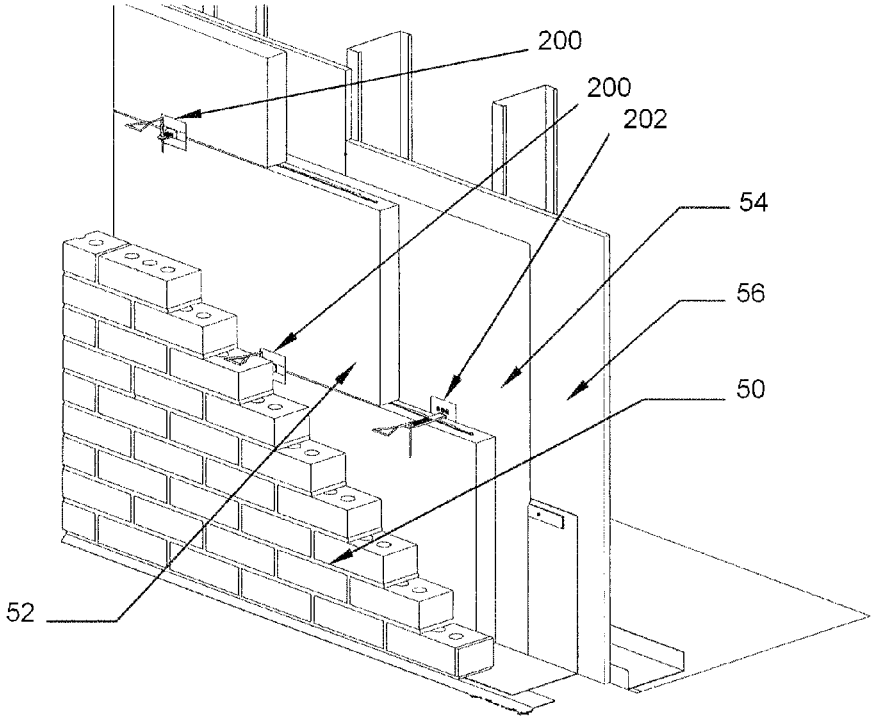
FIG. 11 is a perspective view of a plurality of masonry ties of FIG. 9 shown in an application with the masonry anchors.

Adjacent the toothed section 214 opposite the blank portion 218 on the shaft is the end portion 220. The end portion 220 has a rounded end 221. The end portion has an aperture, such as an anchor hole 222, centered about the arch of the rounded end 221. The end portion 220 may be tapered along its length from the toothed section to the end 221 as shown in FIG. 9. The tapered arrangement allows for easier installation into and the receiving opening 142 of the retaining plate.

A masonry anchor 230 made of formed metal wire may be inserted into the anchor hole 222. The masonry anchor 230 comprises a vertical shaft 232, a horizontal shaft 234, and an interface portion 236. The vertical shaft 232 is connected at a right angle to the horizontal shaft 234. The horizontal shaft connected with the interface portion 236. Other shapes other than a triangle can be used for the interface portion, such as a straight shaft, a T-shaped shaft, a circle, an ellipse, a rectangle, a trapezoid, or another shape. This interface portion is intended to be embedded in mortar of a masonry joint during the construction of the masonry veneer 50.

As is shown in FIGS. 9-12, the base 202 is installed on the backup wall. Insulation panels 52 can be installed between the shafts 212 of spaced apart bases 202. Under other methods, the bases 202 can be installed concurrently with the insulation panels 52. The insulation panels 52 are then held in place by installing, by pushing, the retainer plate 104 on the corresponding shaft 212 of the base 202 until the back of the retainer plate 104 is in contact with the insulation panel 52. The locking arm 146 engages the shaft in a ratcheting action. The back side of the insulation panels 52 rest against the back plate 206 of the base 202, providing for proper alignment and a small gap between the insulation 52 and the back-up wall for drainage. In some application, a bead of sealant 60, such as polyurethane or silicone sealant can be applied to the top and/or bottom wall of the insulation panels 52 as shown in FIG. 7 to seal between adjacent panels and about the shaft 212 of the base.

The base 202 can be positioned on the backup wall so a masonry anchor 230 connected to the corresponding shaft 212 can be located in a mortar joint 55. Then the masonry veneer 50 10 can be constructed so that at least the interface portion of a masonry anchor 230 can be positioned in a mortar joint 55 between adjacent bricks or blocks of the veneer 50 and that vertical shaft of the masonry anchor can be received into the anchor hoe 222 of the shaft 212 shown in FIGS. 10-12. In some applications, any of a portion of the interface portion or the entire interface portion may be located within the mortar joint 55 and 15 surrounded by mortar.

Figure 12:
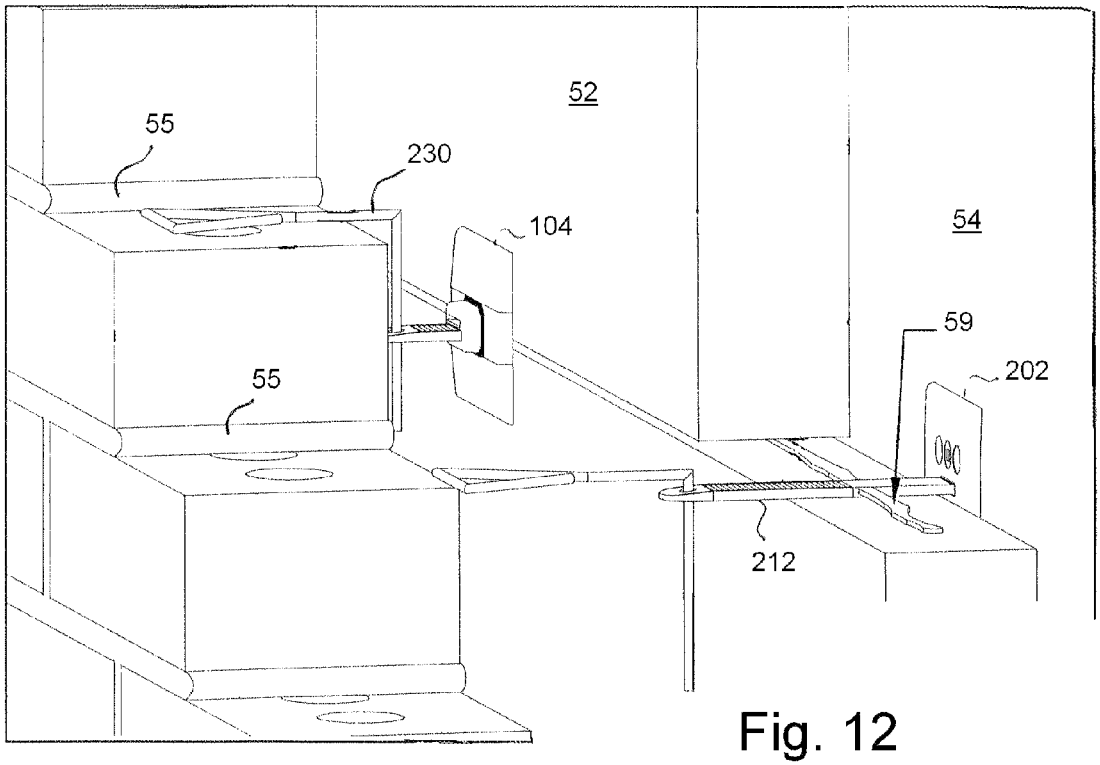
FIG. 12 is an enlarged perspective view taken from FIG. 11 of a plurality of masonry ties of FIG. 9 shown in the application with the masonry anchors.
Figure 13:
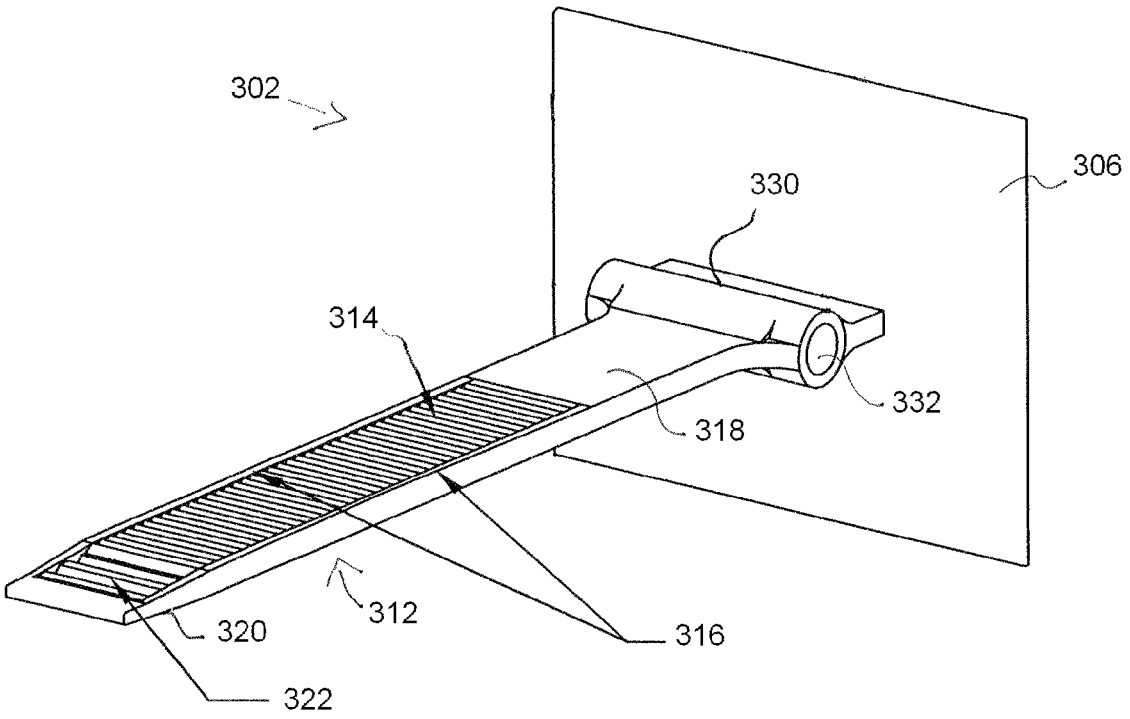
FIG. 13 is a perspective view of a base of a third embodiment masonry tie.
Figure 14:
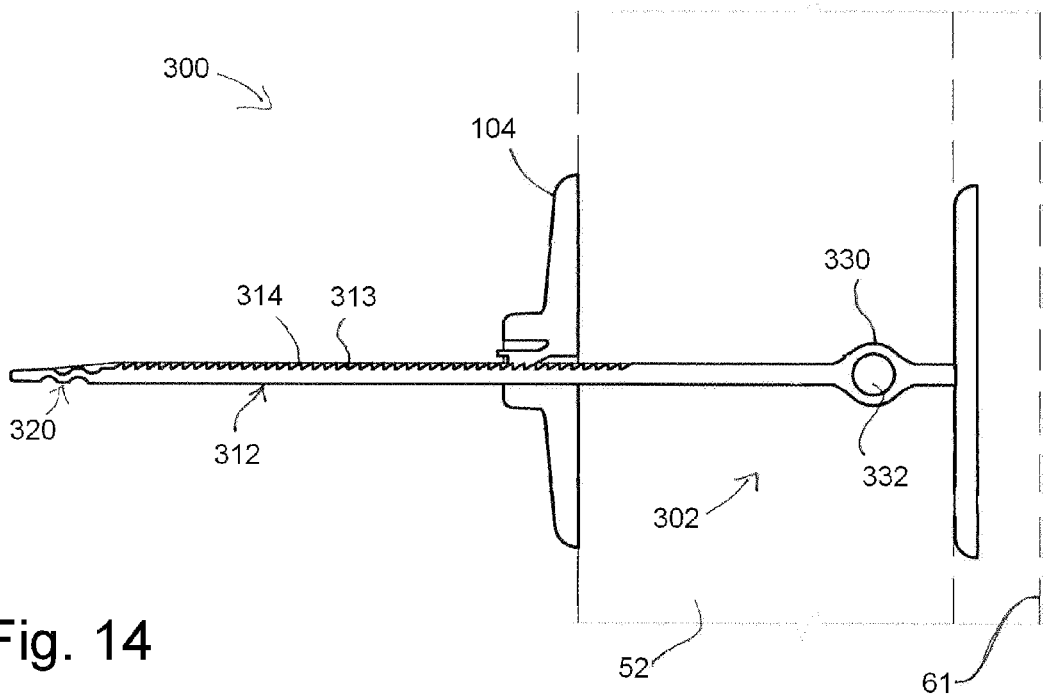
FIG. 14 is a side sectional view of the third embodiment masonry tie.

In some application, as is shown in FIG. 12, the entire interface portion 236 and a portion of the horizontal shaft 234 will be located within the mortar joint 55 and surrounded by mortar. The use of the mortar anchors allows for increase adjustability of the vertical location of the connection between the mortar anchor and the shaft 212 as compared to the arrangement shown in 6-7 where the vertical location of the shaft 112 must intersect the mortar joint. The masonry anchor's connection at one end to the veneer 50 at the mortar joint 55 and on an opposite end to the shaft 212 of the base 202 provide support to the veneer from the backup wall to which the base is connected. Further masonry ties positioned at the same vertical location on the back up wall can service different, vertically spaced apart, mortar row joints as shown in FIG. 14 depending on the length of the vertical shaft of the masonry anchor and the depth to which it is installed into the anchor hole 222.

Third Embodiment

FIGS. 13-17 show a third embodiment masonry tie 300. The third embodiment comprises a modified base 302 and the retainer plate 104 from the first embodiment masonry tie 100. One application for third embodiment masonry tie 300 is with a masonry backup wall 61.

The third embodiment base 302 is identical to base 102, except that a blank portion 318 of a shaft 312 comprises a mounting passage 332. The base 302 has a back plate 306 and a shaft 312 extending from the back plate. The shaft 312 has the blank portion 318, a toothed section 314 comprising teeth 313, and an end portion 320. The blank portion 318 is adjacent the back plate 306. On opposite lateral sides of the toothed section are shoulders 316.

The mounting passage 332 is located within a mounting passage housing 330 that extends above and below the adjacent flat portions of the blank portion 318. The mounting passage extends transversely through the shaft 312. In some embodiments, the mounting passage is a cylinder. In some embodiments, the mounting passage has other cross-sectional shapes, such a square. The mounting passage is configured to receive a mounting arm 68 of a reinforcing ladder 66 and to be supported in place on the mounting arm 68. The distance between the mounting passage and the back plate 306 of the base 302 can be varied at manufacturing to provide different versions of the base having difference distances between the back plate and the mounting passage to allow for variations in placement of the reinforcing ladder in the field.

Figure 18:
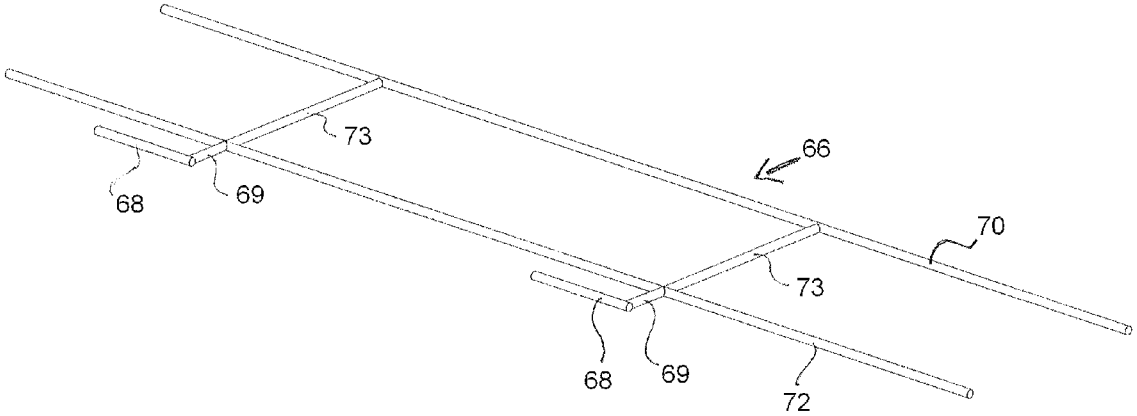
FIG. 18 is a perspective view a reinforcing ladder shown in FIG. 17.
Figure 19:
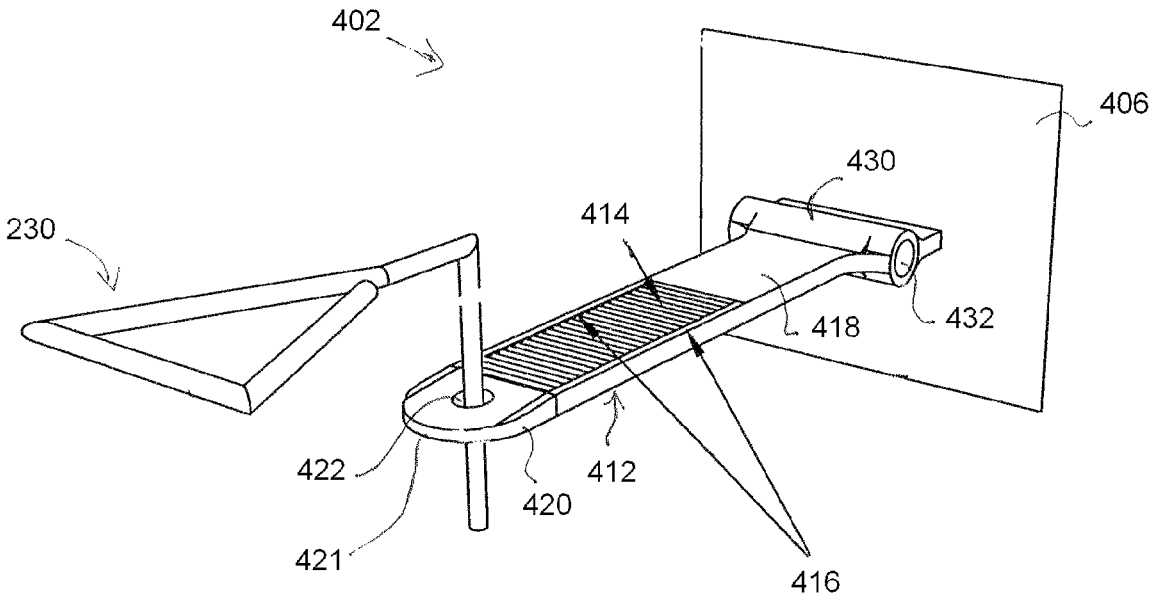
FIG. 19 is a perspective view of a base of a fourth embodiment masonry tie with a masonry anchor.

An exemplary reinforcing ladder 66 is shown in FIG. 18. The reinforcing ladder 66 may be formed of metal. The reinforcing ladder has two parallel members 70 and 72 connected by spaced apart step members 73. Extending from one of the parallel members 72 at the location of one of the step members 73, on a side of the parallel member opposite the step member, is an extension section 69. The extension section 69 spaces the mounting arm 68 from the adjacent parallel member. In some embodiments the mounting arm 68 is parallel to one or both of the parallel members 70 and 72.

Figure 15:
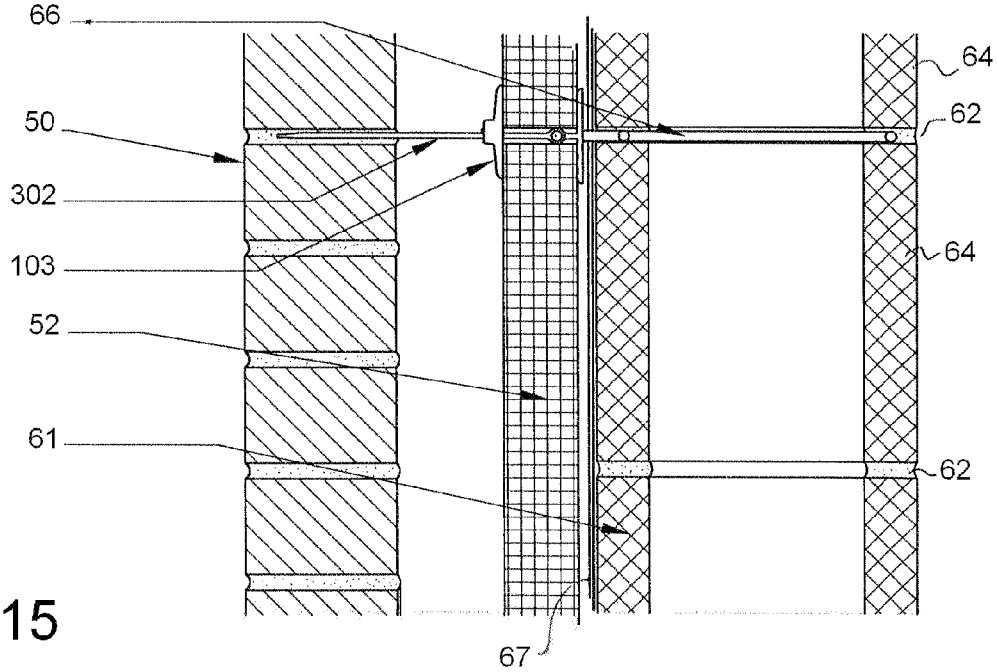
FIG. 15 is a side view of the third embodiment masonry tie in an application.
Figure 16:
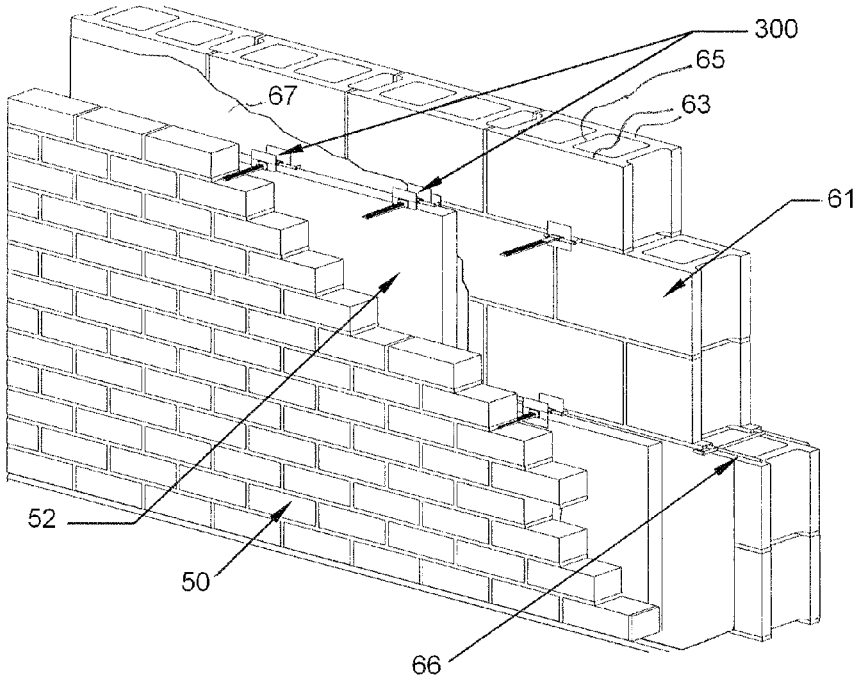
FIG. 16 is a perspective view of a plurality of masonry ties of FIG. 14 in an application.
Figure 17:
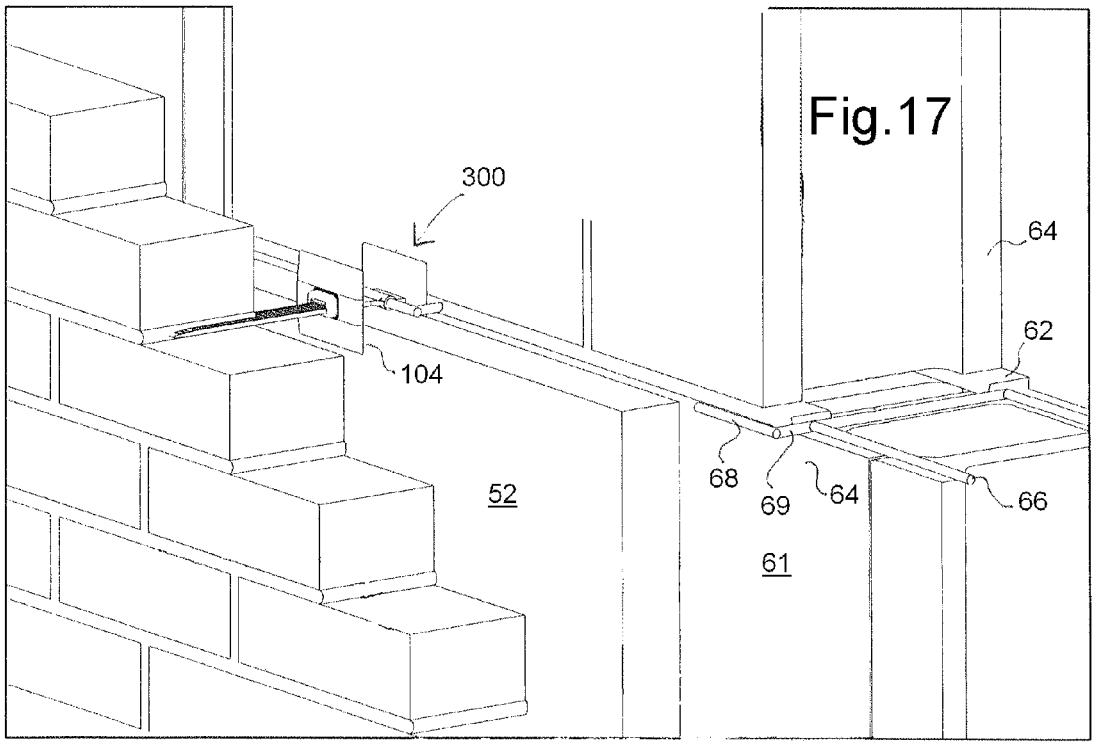
FIG. 17 is an enlarged perspective view taken from FIG. 16 of a plurality of masonry ties of FIG. 14 in the application.

The masonry backup wall comprises a plurality of blocks 64, such a cement blocks that are connected by being laid in mortar vertically on top of another. A horizontal masonry backup wall joint 62 is formed between vertically adjacent blocks 64 as shown in FIGS. 15-17. Vertical masonry backup wall joint are formed between horizontally adjacent blocks. The masonry joints comprise mortar or other joining substances known in the art. One or more reinforcing ladders 66 are placed in the mortar of the horizontal masonry backup wall joints 62 when those joints are formed. Forming of such joints can involve laying the reinforcing ladder 66 on a top surface of a first masonry block 64, applying a layer of mortar to the top surface of the masonry block to fully or partially cover the reinforcing ladder 66, placing a second masonry block on the applied mortar above the first masonry block, and allowing the mortar to harden. The reinforcing ladder may be placed on the blocks so that the parallel members 70, 72 rest on the opposite outside walls 63 of the masonry block 64 and the step(s) 73 rest on at least some of the cross-walls 65 of the masonry block.

As shown in FIG. 16-17, the reinforcing ladders may be placed in every other horizontal masonry backup wall joint 62. In some applications, the reinforcing ladders are placed in every horizontal masonry backup wall joint 62.

The location of the reinforcing ladder may be located relative to the masonry backup wall outer surface so that when the base 302 is installed on the mounting arm 68 that the back of the back plate 306 is in contact with the outer face of the masonry backup wall or any covering 61, such as an AB/WRB, on the back-up that might be applied to the face of the masonry backup wall. Even when arranged in this fashion the thickness of the back plate 306 spaces the insulation from the exterior surface of the AB/WRB on the backup wall. The arrangement of FIGS. 14-15 shows the base is in contact with the back surface of the insulation 52 and is spaced from the backup wall 61 and the AB/WRB 67 so there is a gap for ventilation and drainage.

The mounting passage 332 allows for differential movement between the masonry back-up and the veneer by allowing the assembly to slide horizontally on the mounting arm 68 after installation.

Other than the connection of the base 302 to the mounting arm 68 of the reinforcing ladder at the mounting passage 332, the third embodiment masonry tie 300 is installed and used in the same manner as masonry tie 100.

Fourth Embodiment

FIGS. 18-22 show a fourth embodiment masonry tie 400. The fourth embodiment comprises a modified base 402 and the retainer plate 104 from the first embodiment masonry tie 100. One application for third embodiment masonry tie 300 is with a masonry backup wall 61.

The fourth embodiment base 402 is identical to base 202, except that it comprises the a transverse mounting passage 432 from the third embodiment base 302 and lacks the three screw openings in the back plate 206. The base 402 has a back plate 406 and a shaft 412 extending from the back plate. The shaft 412 has the blank portion 418, a toothed section 414 comprising teeth 413, and an end portion 420. The blank portion 418 is adjacent the back plate 406. On opposite lateral sides of the tooth section are shoulders 416.

Figure 20:
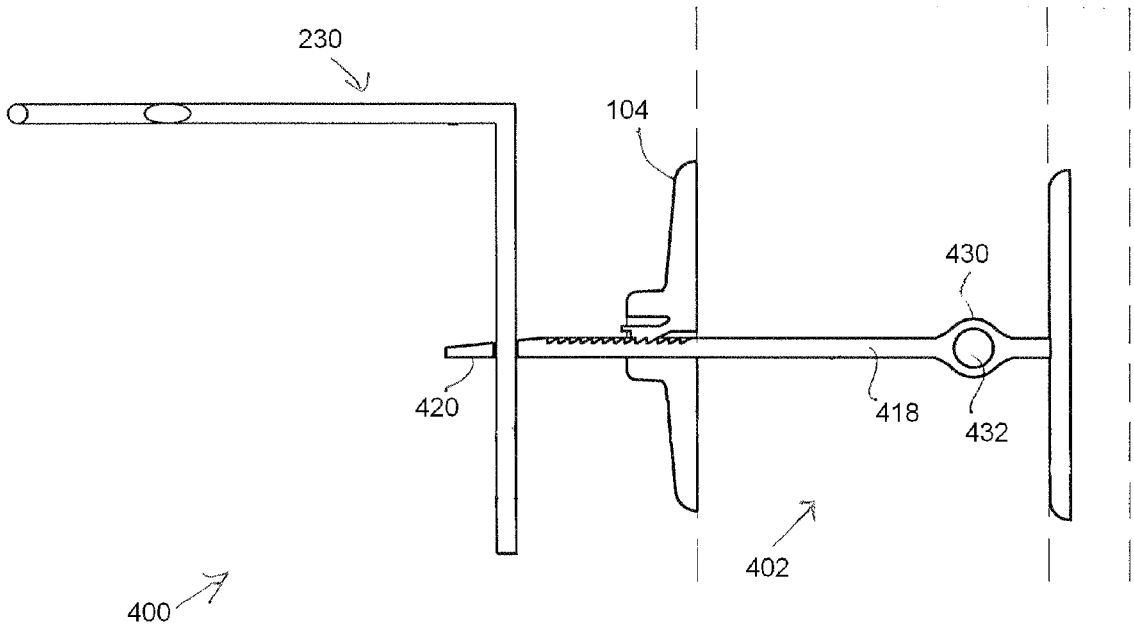
FIG. 20 is a side sectional view of the fourth embodiment masonry tie with the masonry anchor.
Figure 21:
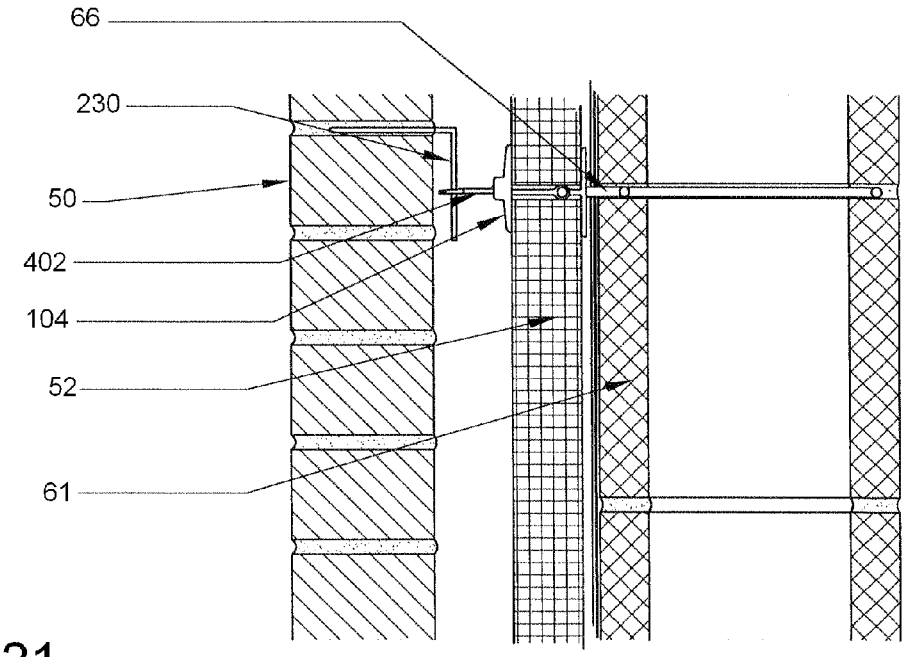
FIG. 21 is a side view of the masonry tie and masonry anchor of FIG. 20 in an application.
Figure 22:
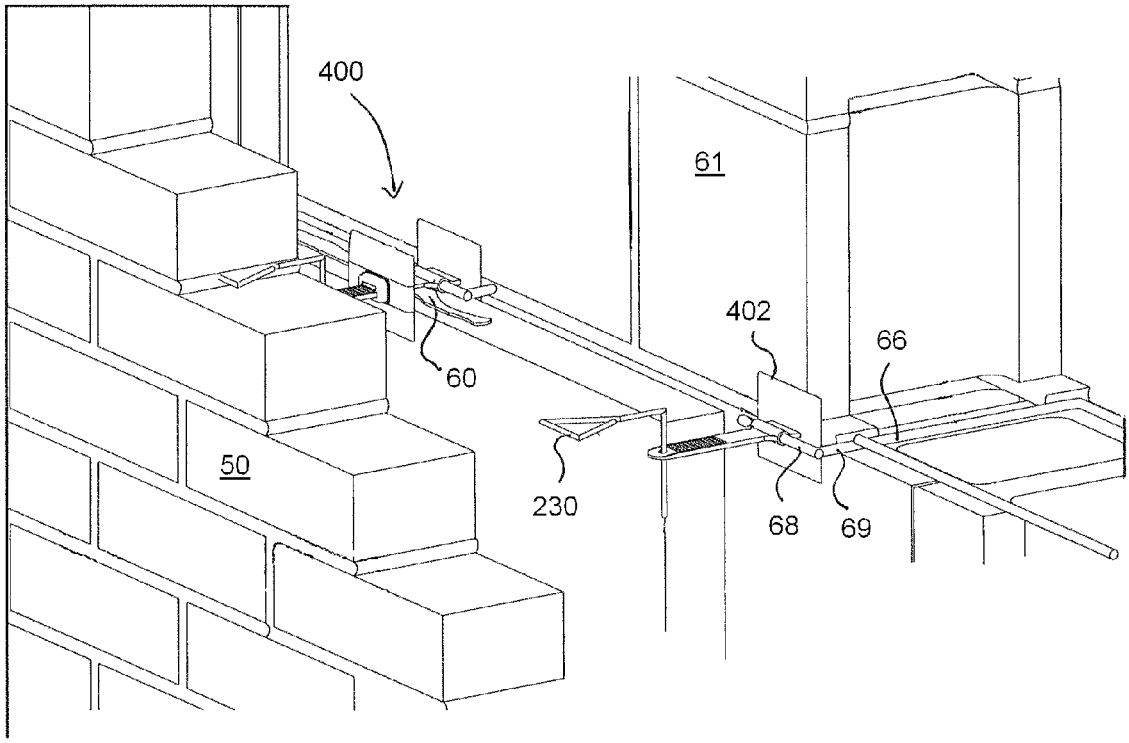
FIG. 22 is a perspective view of the masonry tie and masonry anchor of FIG. 20 in an application.

The end portion 420 has a rounded end 421. The end portion has an aperture, such as an anchor hole 422 centered about the arch of the rounded end 421. The end portion 420 may be tapered along its length from the toothed section to the end 421 as shown in FIG. 20. The masonry anchor 230 may be inserted into the anchor hole 222 and connected to the veneer 50 as described above regarding the second embodiment masonry tie 200. The base 402 is connected to the mounting arm 68 of the reinforcing ladder as described regarding base 302.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A masonry tie for providing a support connection between a vertical veneer wall and a vertical backup wall, comprising:

a base comprising a shaft and a back plate, the shaft extending from the back plate, the shaft comprising a plurality of teeth and a masonry grip section at a distal end adjacent the plurality of teeth and opposite the back plate, the distal end section for locating in a masonry join of the veneer wall, the shaft is permanently joined to the back plate;

the masonry grip section comprises plurality of recesses to interlock with a masonry joint of the veneer wall, the masonry grip section is distinct from the plurality of teeth;

the back plate comprising one or more fastening apertures for receiving one or more fasteners to connect the back plate to the vertical backup wall; and, a retainer plate comprising a receiving opening and a locking arm, the receiving opening configured to receive the shaft, the locking arm is adjacent the receiving opening, the locking arm is pivotally biased to engage at least one of the plurality of teeth when the at least one of the plurality of teeth is adjacent the locking arm to prevent the retainer plate from moving away from the back plate, the retainer plate configured to hold an insulation panel against the back plate when the retainer plate is moved to a holding position along the shaft.

2. The masonry tie of claim 1, wherein the locking arm is releasably biased toward engagement with at least one of the plurality of teeth of the shaft.

3. The masonry tie of claim 1, wherein the locking arm comprises a released position and an engaged position, the locking arm is engaged with at least one of the plurality of teeth when the at least one of the plurality of teeth is adjacent the locking arm to prevent the retainer plate from moving away from the back plate when in the engaged position, and the locking arm is released from the plurality of teeth and the retainer plate is free to move in two directions along the shaft when the locking arm is in the released position.

4. The masonry tie of claim 1, wherein the locking arm comprises locking arm teeth that engage with the at least one of the plurality of teeth of the shaft to prevent the retainer plate from moving away from the back plate.

5. The masonry tie of claim 1, comprising a ratcheting mechanism, the ratcheting mechanism comprises the locking arm and the plurality of teeth, which when engaged prevent the retainer plate from moving away from the back plate.

6. The masonry tie of claim 1, wherein the back plate comprises a back surface, the back surface is concave.

7. The masonry tie of claim 1, wherein the masonry grip section comprises a plurality of corrugations for engaging the masonry join of the veneer wall, the plurality of corrugations comprise the plurality of recesses, the masonry grip section is distinct from the plurality of teeth in that a corrugation spacing between adjacent corrugations of the plurality of corrugations is different from a tooth spacing between adjacent teeth of the plurality of teeth.

8. The masonry tie of claim 1, wherein the masonry grip section comprises a plurality of corrugations for engaging the masonry join of the veneer wall, the plurality of corrugations comprise the plurality of recesses, the masonry grip section is distinct from the plurality of teeth in that the plurality of corrugations comprise a shape that is different from a shape of the plurality of teeth.

9. The masonry tie of claim 8, wherein the plurality of corrugations extend transverse to a longitudinal length of the shaft and wherein the plurality of teeth extend transverse to the longitudinal length of the shaft.

10. The masonry tie of claim 1, wherein there plurality of recesses extend transverse to a longitudinal length of the shaft.

11. The masonry tie of claim 1, wherein the plurality of recesses extend transverse to a longitudinal length of the shaft and wherein the plurality of teeth extend transverse to the longitudinal length of the shaft.

12. A masonry tie for providing a support connection between a vertical veneer wall to a vertical backup wall, comprising:

a base comprising an elongated member and a mounting plate, the elongated member extending from the mounting plate, the elongated member comprising a plurality of teeth and a distal end section, the distal end section is adjacent the plurality of teeth and opposite the mounting plate, the elongated member is permanently joined to the mounting plate;

the distal end section comprises a plurality of corrugations for engaging a mortar of a masonry joint of the veneer wall, a corrugation spacing between adjacent corrugations of the plurality of corrugations is different from a tooth spacing between adjacent teeth of the plurality of teeth;

the mounting plate comprising a one or more fastening apertures for receiving a one or more fasteners to connect the mounting plate to the vertical backup wall; and, a retainer plate comprising a receiving opening and a ratcheting mechanism, the receiving opening sized to receive the elongated member, the ratcheting mechanism comprises a locking member engageable with at least one of the plurality of teeth to prevent retainer plate from moving away from the mounting plate, the retainer plate configured to hold an insulation panel against the mounting plate when the retainer plate is moved to a holding position along the shaft.

13. The masonry tie of claim 12, wherein the locking member is releasably biased toward engagement with at least one of the plurality of teeth of the elongated member.

14. The masonry tie of claim 12, wherein the locking member comprises a released position and an engaged position, the locking member is engaged with at least one of the plurality of teeth when the at least one of the plurality of teeth is adjacent the locking member to prevent the retainer plate from moving in the at least one direction when in the engaged position, and the locking member is released from the plurality of teeth and the retainer plate is free to move in two directions along the elongated member when the locking member is in the released position.

15. The masonry tie of claim 12, wherein the locking member comprises locking member teeth that engage with the at least one of the plurality of teeth of the elongated member to prevent the retainer plate from moving away from the back plate.

16. The masonry tie of claim 12, wherein the corrugation spacing between adjacent corrugations of the plurality of corrugations is larger than the tooth spacing between adjacent teeth of the plurality of teeth.

17. The masonry tie of claim 16, wherein the plurality of corrugations comprise a profile that is different from a profile of the plurality of teeth.

18. The masonry tie of claim 12, wherein the mounting plate comprises a concave back surface and wherein the retainer plate comprises a concave back surface.

19. A masonry tie for providing a support connection between a vertical veneer wall and a vertical backup wall, comprising:

a base comprising a shaft and a back plate, the shaft extending from the back plate, the shaft comprising a plurality of teeth and a distal end section adjacent the plurality of teeth and opposite the back plate, the distal end section for locating in a masonry join of the veneer wall, the shaft is permanently joined to the back plate;

the distal end section comprises a plurality of corrugations for engaging the masonry join of the veneer wall, a corrugation spacing between adjacent corrugations of the plurality of corrugations is different from a tooth spacing between adjacent teeth of the plurality of teeth;

the back plate comprising one or more fastening apertures for receiving one or more fasteners to connect the back plate to the vertical backup wall; and, a retainer plate comprising a receiving opening and a locking arm, the receiving opening configured to receive the shaft, the locking arm is adjacent the receiving opening, the locking arm is pivotally biased to engage at least one of the plurality of teeth when the at least one of the plurality of teeth is adjacent the locking arm to prevent the retainer plate from moving away from the back plate, the retainer plate configured to hold an insulation panel against the back plate when the retainer plate is moved to a holding position along the shaft.

* * * * *